US008196315B2

(12) United States Patent
Ryu

(10) Patent No.: US 8,196,315 B2
(45) Date of Patent: Jun. 12, 2012

(54) SHOE SOLE WITH TUNNEL-TYPE AIR CHAMBERS

(75) Inventor: Jeong Hyeon Ryu, Busan (KR)

(73) Assignee: MESP Co., Ltd., Busan (KR)

( * ) Notice: Subject to any disclaimer, the term of this patent is extended or adjusted under 35 U.S.C. 154(b) by 508 days.

(21) Appl. No.: 12/381,329

(22) Filed: Mar. 11, 2009

(65) Prior Publication Data

US 2009/0241372 A1 Oct. 1, 2009

(30) Foreign Application Priority Data

Mar. 25, 2008 (KR) ..... 10-2008-0027556

(51) Int. Cl.
*A43B 7/06* (2006.01)

(52) U.S. Cl. ..... 36/3 R; 36/3 B; 36/29

(58) Field of Classification Search ..... 36/3 R, 36/3 B, 28, 29, 35 R, 35 B
See application file for complete search history.

(56) References Cited

U.S. PATENT DOCUMENTS

| | | | | |
|---|---|---|---|---|
| 1,932,557 | A | 10/1933 | Meucci | |
| 2,098,412 | A * | 11/1937 | Bovay | 36/3 R |
| 2,239,211 | A * | 4/1941 | Wylie | 36/3 B |
| 4,438,573 | A * | 3/1984 | McBarron | 36/3 B |
| 4,813,160 | A * | 3/1989 | Kuznetz | 36/3 R |
| 5,400,526 | A * | 3/1995 | Sessa | 36/3 B |
| 6,948,260 | B2 * | 9/2005 | Lin et al. | 36/3 B |
| 7,337,557 | B2 * | 3/2008 | Miyata | 36/3 B |
| 2004/0078996 | A1 | 4/2004 | Brooks | |
| 2005/0138838 | A1 | 6/2005 | Lin et al. | |
| 2007/0051013 | A1 * | 3/2007 | Akhidime | 36/3 B |

FOREIGN PATENT DOCUMENTS

| | | |
|---|---|---|
| EP | 1447020 | 8/2004 |
| KR | 20020019358 | 3/2002 |

* cited by examiner

*Primary Examiner* — Marie Patterson
(74) *Attorney, Agent, or Firm* — Jordan and Hamburg LLP

(57) ABSTRACT

A main body of a shoe sole includes a recess formed at an upper surface thereof and a non-slip cushion sheet attached to a bottom surface thereof, wherein pluralities of air chamber grooves are formed in the recess at a front portion of the main body and an air chamber groove is formed in the recess at a rear portion of the main body. A shoe liner covers open upper portions of the air chamber grooves so as to provide pluralities of tunnel-type air chambers. An outer periphery of the shoe liner is attached to an outer periphery of the upper surface of the main body and other portions of the shoe liner are inserted into the recess. The binding line between the shoe liner and the main body is snugly positioned within the interior boundary of the main body.

3 Claims, 5 Drawing Sheets

【Fig 1】
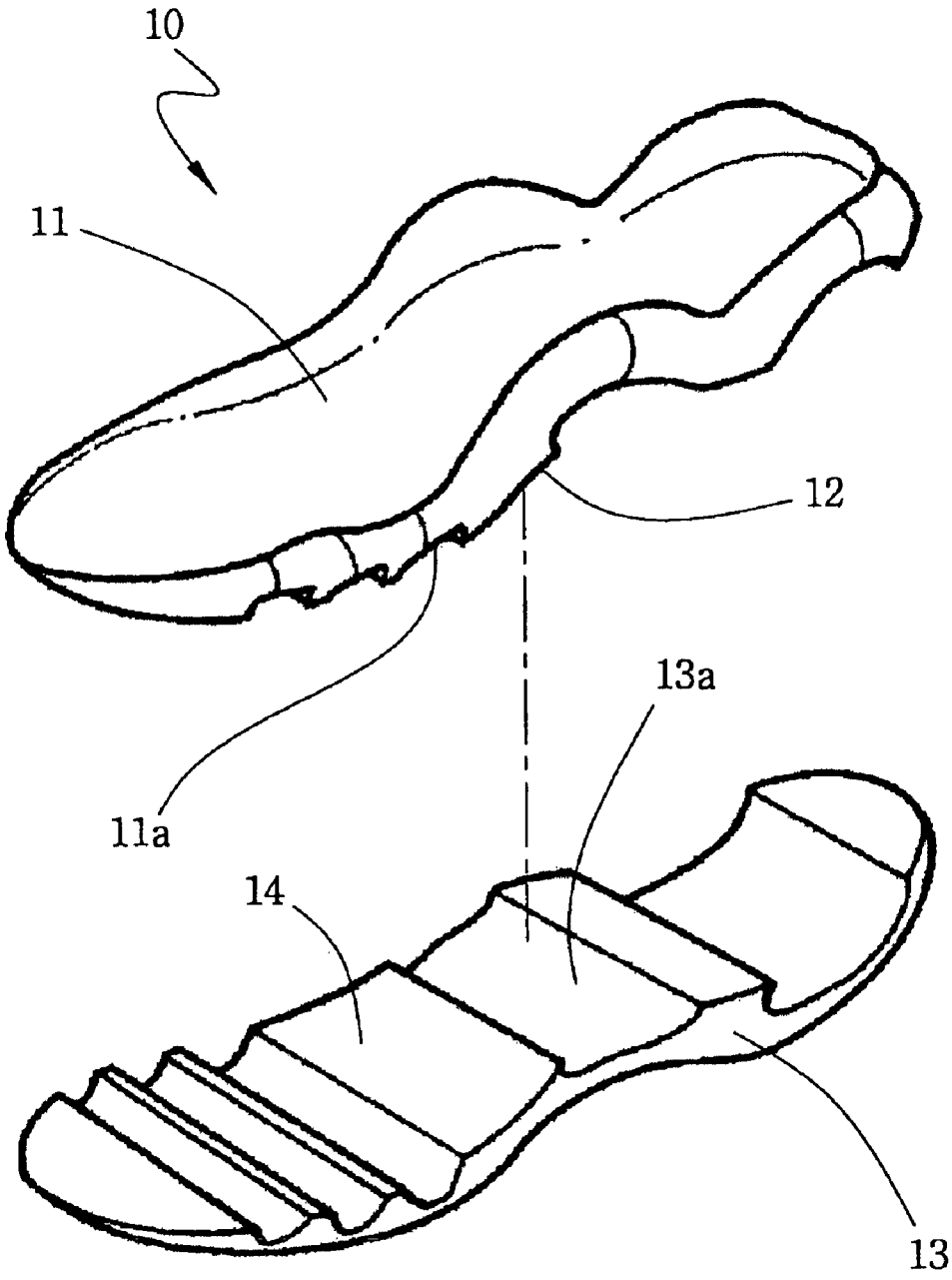
RELATED ART

【Fig 2】
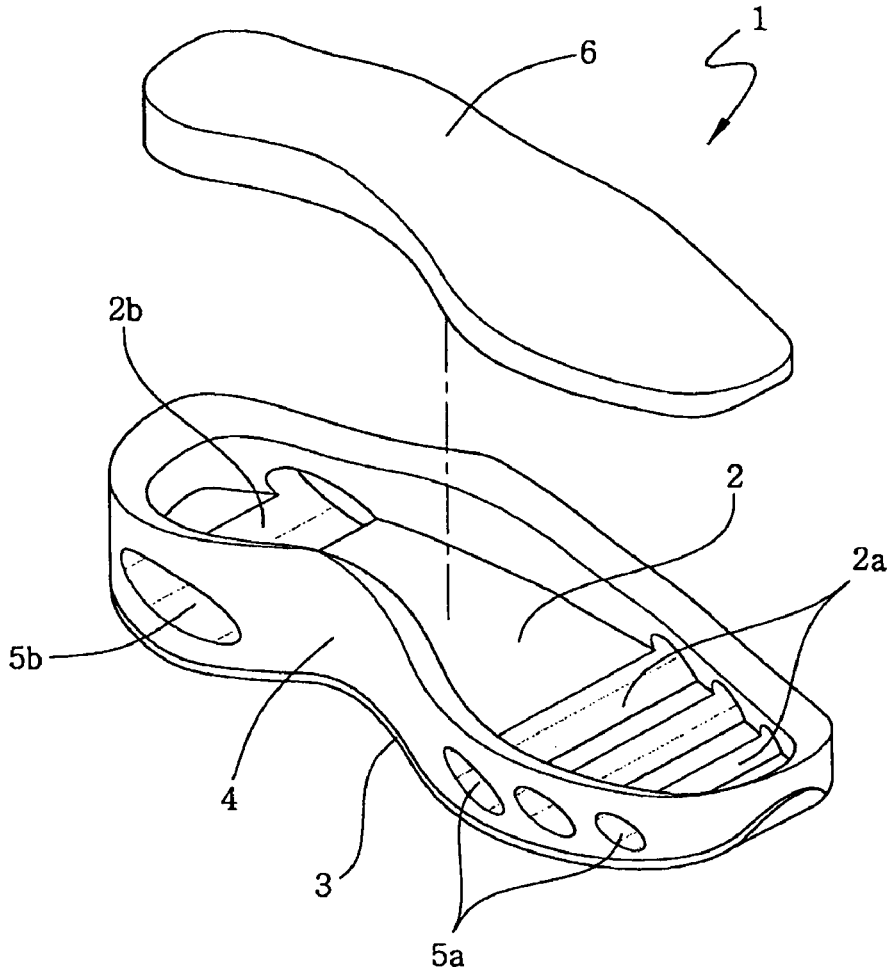
【Fig 3】
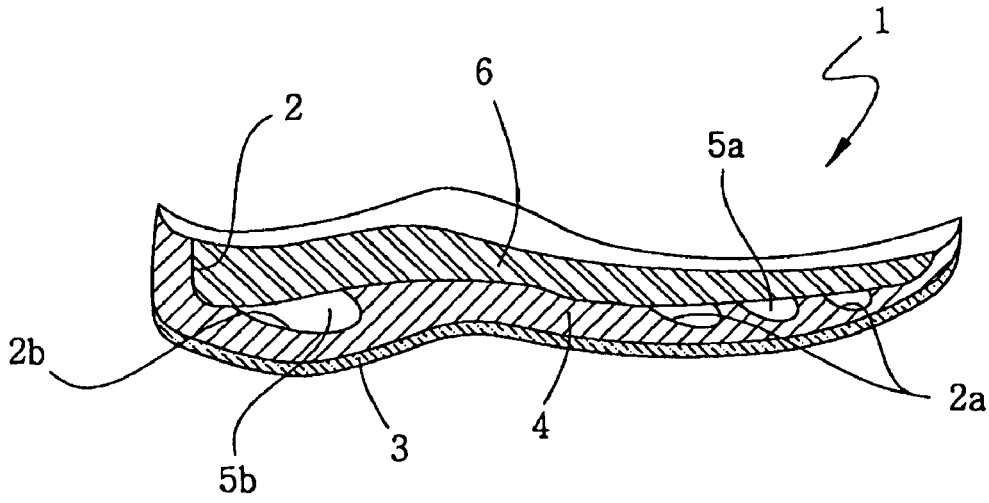

【Fig 4】
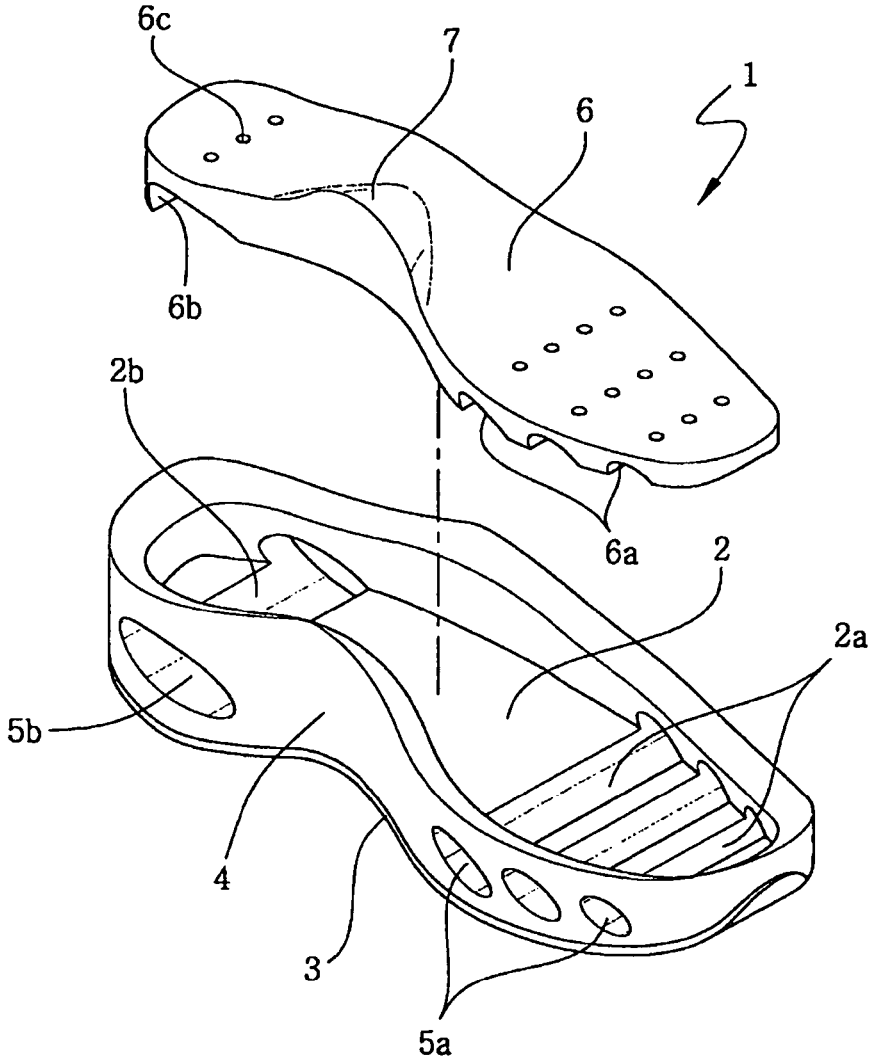
【Fig 5】
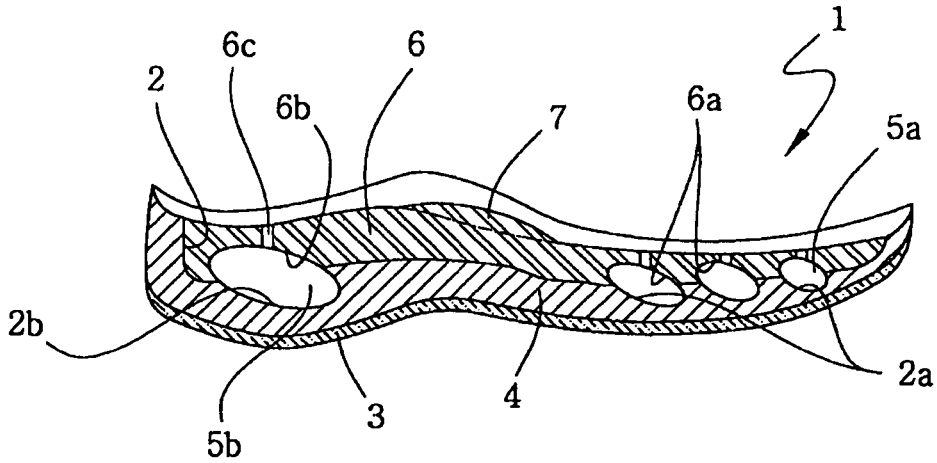

【Fig 6】
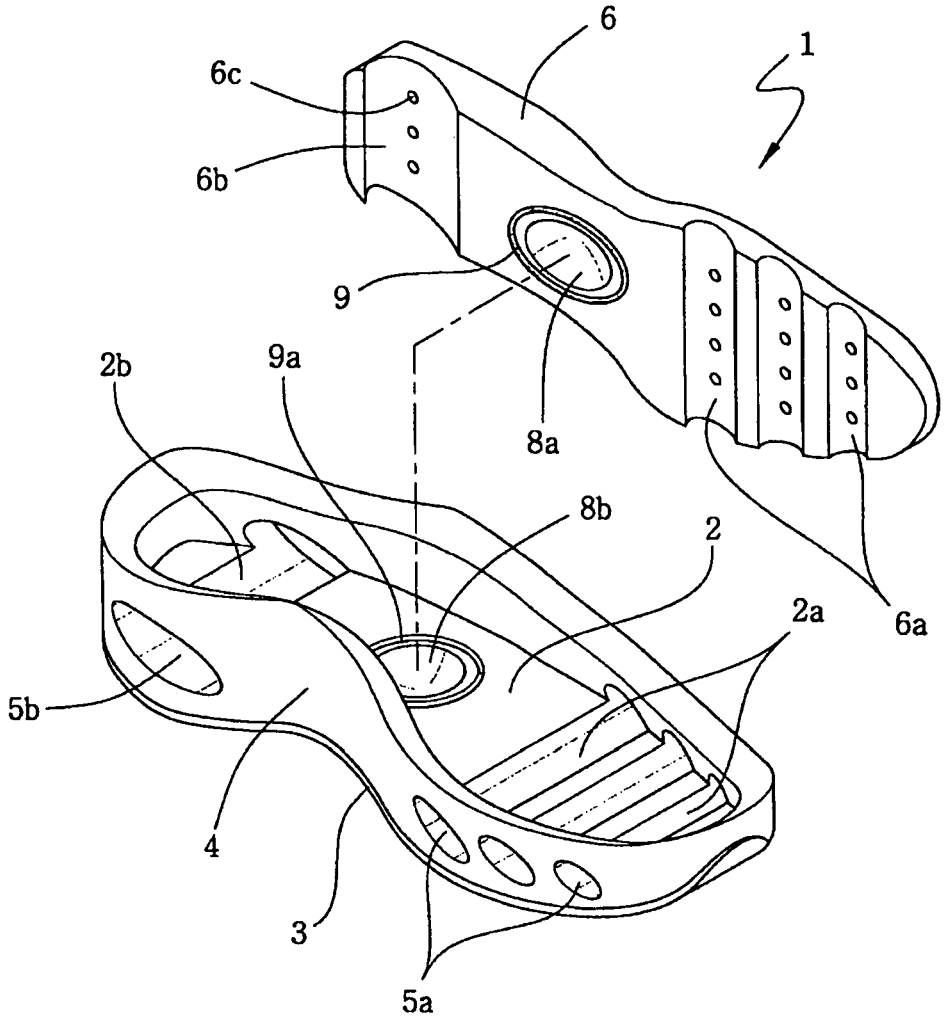
【Fig 7】
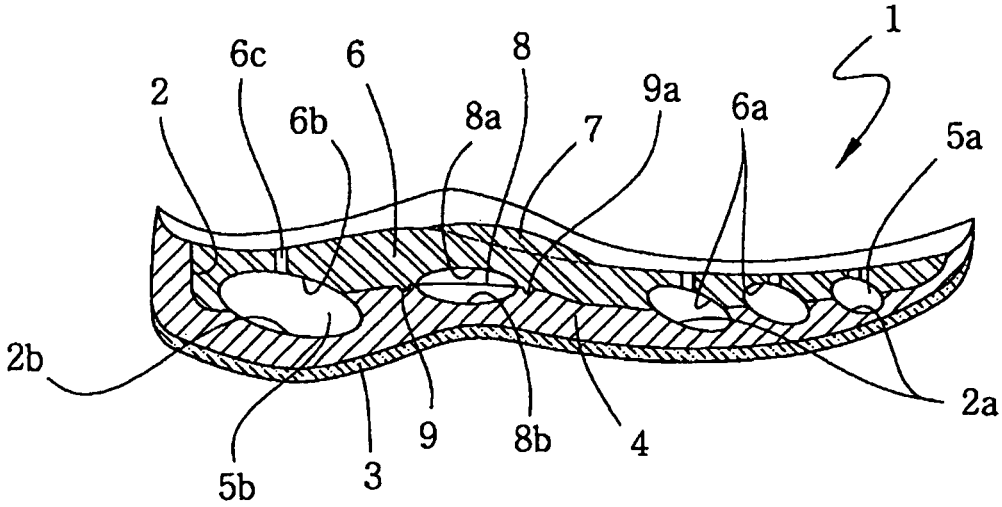

【Fig 8】
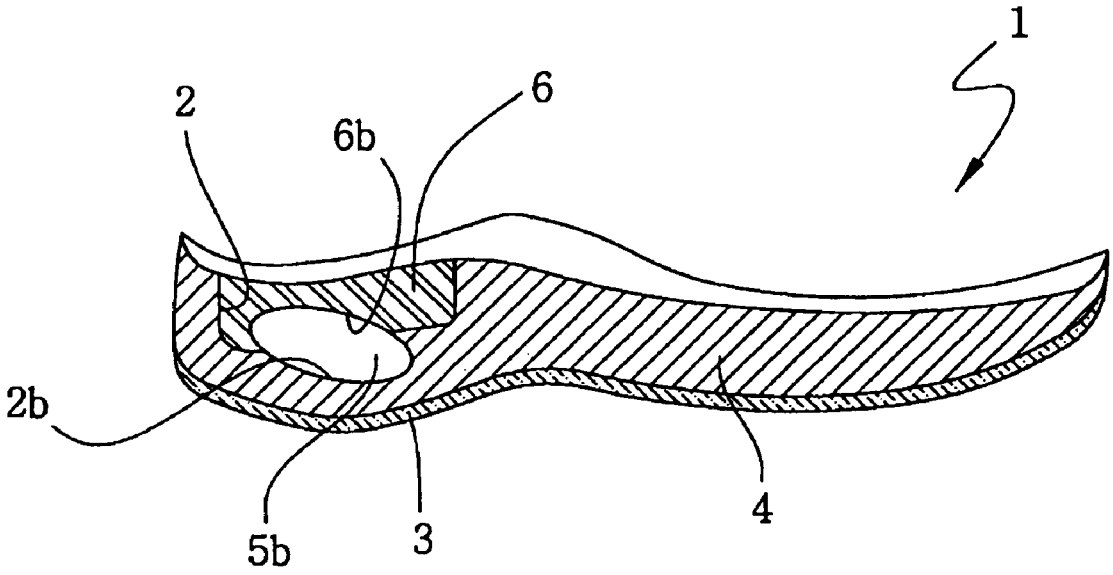

SHOE SOLE WITH TUNNEL-TYPE AIR CHAMBERS

BACKGROUND OF THE INVENTION

1. Field of the Invention

The present invention relates generally to a shoe sole having tunnel-type air chambers, and more particularly to a shoe sole having tunnel-type air chambers capable of good elastic air cushioning and shock-absorbing effects for relieving foot pressure during the entire walking gait cycle of a wearer by providing the shoe sole with the tunnel-type air chambers at the boundary between a shoe liner and a main body of the shoe, which is capable of providing the shoe sole with good appearance by preventing the combining line between the shoe liner and the main body from being exposed to the outside, and by preventing foreign substances from being introduced through the binding line, and which is capable of enhancing the functionality and the feelings to wear by providing the shoe liner with pluralities of through holes and by providing the shoe liner with an arched supporting portion and by providing the main body with a center air chamber. In the shoe sole according to the present invention, the main body includes a recess formed at an upper surface thereof and a non-slip cushion sheet attached to a bottom surface thereof, wherein pluralities of air chamber grooves are formed in the recess at a front portion of the main body and an air chamber groove is formed in the recess at a rear portion of the main body. The shoe liner covers open upper portions of the air chamber grooves so as to provide pluralities of tunnel-type air chambers. An outer periphery of the shoe liner is attached to an outer periphery of the upper surface of the main body and other portions of the shoe liner are inserted into the recess. The binding line between the shoe liner and the main body is snugly positioned within the interior boundary of the main body in a manner that it has an extended warranty to give good appearance to the shoe sole. The through holes are fluid-communicated with the tunnel-type air chambers of the main body. Furthermore, the arched supporting portion is formed at the center portion of the upper surface of the shoe liner and it bulges out at the upper surface of the shoe liner. In addition, the center air chamber is provided between the center portion of the lower surface of the shoe liner and the center portion of the upper surface of the main body. Due to this structure, it can give pleasant and refreshing feeling to a wearer during the entire walking gait cycle of the wearer at the summer season. Further, the arched supporting portion may uniformly support the sole of wearer's foot during the entire walking gait cycle of a wearer. Consequently, it is possible to enhance the functionality and the feelings to wear.

2. Description of the Prior Art

A variety of shoe soles for providing a wearer with comfortable feelings, elastic air cushioning effects and shock-absorbing effects for relieving foot pressure during the entire walking gait cycle of the wearer have been proposed.

One approach is, a shoe sole according to the prior art having shock-absorbing effects has been proposed on Korean Pat. No. 10-724466 issued to S.Y. Cho on the date of May 28, 2007. As shown in FIG. 1, the shoe sole 10 according to the prior art comprises an upper sole 11 and a lower sole 13, which are divided into two half-pieces. A cutaway surface 12 is formed on a bottom surface of the upper sole 11, thereby resulting in the formation of a recess 11*a*. Likewise, a cutaway surface 14 is formed on an upper surface of the lower sole 13, thereby resulting in the formation of a recess 13*a*. The cutaway surface 12 of the upper sole 11 corresponds to the recess 13*a* of the lower sole 13 and the cutaway surface 14 of the lower sole 13 corresponds to the recess 11*a* of the upper sole 11. In order to combine the upper sole 11 and the lower sole 13, an adhesive agent may be applied to the cutaway surfaces 12, 14. When the upper sole 11 is engaged with the lower sole 13, pluralities of lateral through holes may be provided in the shoe sole 10.

In the shoe sole according to the prior art as described above, if any impact force caused by the weight of a wearer during walking or running on the uneven road is applied to the shoe sole, the through holes may be elastically transformed. As a result, it is possible to absorb the impact force, thereby resulting in good elastic air cushioning and shock-absorbing effects for relieving foot pressure.

One drawback of such known shoe sole is that the combining line between the upper sole 11 and the lower sole 13 may be exposed to the outside, thereby resulting in the deterioration of an appearance. Another drawback of such known shoe sole is that some objects such as foreign materials may be locked at the combining line of the shoe sole during the entire walking gait cycle of a wearer. Another drawback of such known shoe sole is that the combining surfaces between the upper sole 11 and the lower sole 13 is apt to be separated from each other due to the penetration of water or foreign materials and thereby it may shorten the life of shoe sole.

SUMMARY OF THE INVENTION

In consideration of the above-mentioned disadvantages or inconveniences of the conventional shoe sole, an object of the present invention is to provide a shoe sole having tunnel-type air chambers capable of good elastic air cushioning and shock-absorbing effects for relieving foot pressure during the entire walking gait cycle of a wearer by providing the shoe sole with the tunnel-type air chambers at the boundary between a shoe liner and a main body of the shoe, which is capable of providing the shoe sole with good appearance by preventing the combining line between the shoe liner and the main body of the shoe sole from being exposed to the outside, and by preventing foreign substances from being introduced through the binding line, and which is capable of enhancing the functionality and the feelings to wear by providing the shoe liner with pluralities of through holes and by providing the shoe liner with an arched supporting portion and by providing the main body with the center air chamber.

In order to achieve the object, according to one aspect of the present invention, the present invention provides a shoe sole having a tunnel-type air chamber, the shoe sole comprising:

a main body including a recess formed at an upper surface thereof and a non-slip cushion sheet attached to a bottom surface thereof, in which pluralities of air chamber grooves are formed in the recess at a front portion of the main body and an air chamber groove is formed in the recess at a rear portion of the main body, and they horizontally extend through both side walls of the main body; and a shoe liner for covering open upper portions of the air chamber grooves so as to provide pluralities of tunnel-type air chambers, in which an outer periphery of the shoe liner is attached to an outer periphery of the upper surface of the main body, and other portions of the shoe liner is inserted into the recess.

Pluralities of air chamber grooves are arranged on a front portion of the lower surface of the shoe liner and an air chamber groove is arranged on a rear portion of the lower surface of the shoe liner, in which the air chamber grooves correspond to the air chamber grooves of the main body, respectively.

Pluralities of through holes are formed through the shoe liner. The through holes are formed at the front portion and the rear portion of the shoe liner and they are fluid-communicated with pluralities of air chamber grooves.

An arched supporting portion is formed at a center portion of the upper surface of the shoe liner and it bulges out at the upper surface of the shoe liner and it corresponds to the shape of the sole of the foot.

An air chamber groove for providing a center air chamber in the shoe sole is formed at a center portion of the lower surface of the shoe liner, wherein a sealing protrusion is formed at a circumferential outer periphery of the air chamber groove and it protrudes downwards from the lower surface of the shoe liner. An air chamber groove for providing the center air chamber in the shoe sole is formed at a center portion of the upper surface of the main body and it corresponds to the air chamber groove of the shoe liner. An engaging groove is formed at a circumferential outer periphery of the air chamber groove and it corresponds to the sealing protrusion of the shoe liner.

According to the other aspect of the present invention, the present invention provides a shoe sole having a tunnel-type air chamber, the shoe sole comprising:

a main body including a recess formed at a rear portion of an upper surface thereof and a non-slip cushion sheet attached to a bottom surface thereof, in which one air chamber groove is formed in the recess, and it horizontally extends through both side walls of the main body; and a shoe liner for covering an open upper portion of the air chamber groove, in which an outer periphery of a lower surface of the shoe liner is attached to an outer periphery of the upper surface of the main body and other portions of the shoe liner are inserted into the recess, in which an air chamber groove is also formed at the lower surface of the shoe liner, in which the air chamber groove corresponds to the air chamber groove formed at the main body.

As described above, in the shoe sole having the tunnel-type air chambers according to the present invention, the recess for receiving a part of the shoe liner is formed in the upper surface of the main body and the non-slip cushion sheet is attached to the bottom surface of the main body. Pluralities of air chamber grooves are formed in the recess at the front portion of the main body. Also, one air chamber groove is formed in the recess at the rear portion of the main body. All of air chamber grooves horizontally extend through both side walls of the main body. The outer periphery of the shoe liner may be attached to an outer periphery of the upper surface of the main body, and other portions of the shoe liner are inserted into the recess of the main body. Accordingly, the shoe liner covers the open upper portion of the air chamber groove, thereby resulting in the formation of the tunnel-type air within the shoe sole.

Due to this structure, since the binding line between the shoe liner and the main body is snugly positioned within the interior boundary of the main body, the shoe sole becomes to have a good appearance. Further, it is possible to prevent foreign substances from being introduced through the binding line, and thereby resulting in great enhancement of the durability of the shoe sole.

Furthermore, in the shoe sole having the tunnel-type air chambers according to the present invention, pluralities of through holes are formed through the shoe liner. These through holes are fluid-communicated with the tunnel-type air chambers of the main body. Furthermore, the arched supporting portion is formed at the center portion of the upper surface of the shoe liner and it bulges out at the upper surface of the shoe liner.

In addition, the center air chamber is provided between the center portion of the lower surface of the shoe liner and the center portion of the upper surface of the main body. Due to this structure, it can give pleasant and refreshing feeling to a wearer during the entire walking gait cycle of the wearer at the summer season.

Further, the arched supporting portion may uniformly support the sole of wearer's foot during the entire walking gait cycle of a wearer. Consequently, it is possible to enhance the functionality and the feelings to wear.

BRIEF DESCRIPTION OF THE DRAWINGS

The above object and other characteristics and advantages of the present invention will become more apparent by describing in detail preferred embodiments thereof with reference to the attached drawings, in which:

FIG. 1 is an exploded perspective view of a conventional shoe sole;

FIG. 2 is an exploded perspective view of a shoe sole having a tunnel-type air chamber according to a preferred first embodiment of the present invention;

FIG. 3 is a side sectional view of the shoe sole having a tunnel-type air chamber according to the preferred first embodiment of the present invention, for showing an assembled state thereof;

FIG. 4 is an exploded perspective view of the shoe sole having a tunnel-type air chamber according to preferred second to fourth embodiments of the present invention;

FIG. 5 is a side sectional view of the shoe sole having a tunnel-type air chamber according to the preferred second to fourth embodiments of the present invention, for showing an assembled state thereof;

FIG. 6 is an exploded perspective view of the shoe sole having a tunnel-type air chamber according to a preferred fifth embodiment of the present invention;

FIG. 7 is a side sectional view of the shoe sole having a tunnel-type air chamber according to the preferred fifth embodiment of the present invention, for showing an assembled state thereof; and FIG. 8 is a side sectional view of the shoe sole having a tunnel-type air chamber according to a preferred sixth embodiment of the present invention.

DETAILED DESCRIPTION OF THE INVENTION

Hereinafter, the constitution and the operation of a shoe sole according to preferred embodiments of the present invention will be explained in more detail with reference to the accompanying drawings FIGS. 1 to 8.

Prior to proceeding to the more detailed description of the preferred embodiment according to the present invention, it should be noted that, for the sake of clarity and understanding of the invention identical components which have identical functions have been identified with identical reference numerals throughout the different views which are illustrated in each of the attached drawing Figures.

FIGS. 2 and 3 illustrate a shoe sole having a tunnel-type air chamber according to a preferred first embodiment of the present invention.

As will be best seen in FIGS. 2 and 3, this invention relates to the shoe sole 1 has a substantially arc shape on the whole of which front and rear portions are slanted upwards at a predetermined angle of inclination. The shoe sole 1 comprises a hardened reinforcement main body 4 of which a recess 2 is formed therein and a non-slip cushion sheet 3 is attached to a bottom surface of the main body 4. Pluralities of air chamber grooves 2*a* are formed in the recess 2 at a front portion of the main body 4. Preferably, one air chamber groove 2*b* is formed in the recess 2 at a rear portion of the main body 4. At the front and the rear portions of the main body 4, all of air chamber grooves 2*a*, 2*b* horizontally extend through both side walls of the main body 4. The shoe sole 1 also comprises a shoe liner 6 made of a soft material, which is detachably positioned onto an upper surface of the main body 4. An outer periphery of the shoe liner 6 may be attached to an outer periphery of the upper surface of the main body 4, and other portions of the shoe liner 6 is inserted into the recess 2 of the main body 4. Accordingly, the shoe liner 6 covers the open upper portions of the air chamber grooves 2*a*, 2*b*, thereby resulting in the creation of pluralities of tunnel-type air chambers 5*a*, 5*b* in the shoe sole 1.

In the meantime, the shoe liner 6 is made of a soft synthetic resin or a synthetic rubber material softer than that used for the main body 4, and the outer periphery thereof is arranged on the upper surface of the main body 4 around the recess 2. For example, if the main body 4 is made of urethane foam, the shoe liner 6 may be made of urethane foam which is more foamable than that used for the main body 4.

The non-slip cushion sheet 3 for preventing a wearer from slipping on a road surface during walking of the user is attached to the bottom surface of the main body 4. The non-slip cushion sheet 3 further prevents the bottom surface of the main body 4 from being worn out as time goes on. The non-slip cushion sheet 3 is made of a synthetic resin or a synthetic rubber material harder than that used for the main body 4. For example, if the main body 4 is made of urethane foam, the non-slip cushion sheet 3 may be made of a urethane material that is not foamed.

As shown in FIG. 2, the front air chamber grooves 2*a* are formed to have a semicircle-shaped groove and they are uniformly arranged on the toe portion of the main body 4. Likewise, the rear air chamber groove 2*b* is formed to have a semicircle-shaped groove and it is arranged on the heel portion of the main body 4. Preferably, the diameter of the rear air chamber groove 2*b* is larger than the diameter of the front air chamber grooves 2*a*.

According to the preferred first embodiment of the present invention as described above, the shoe liner 6 is engaged with the main body 4 in a manner that the outer periphery of the lower surface of the shoe liner 6 is attached to the outer periphery of the upper surface of the main body 4 by using an adhesive agent and other portions of the shoe liner 6 are inserted into the recess 2 of the main body 4. Accordingly, the shoe liner 6 covers the open upper portions of the air chamber grooves 2*a*, 2*b*, thereby resulting in the creation of pluralities of tunnel-type air chambers 5*a*, 5*b* in the shoe sole 1. At this time, the binding line between the shoe liner 6 and the main body 4 is not exposed to the outside. Since the binding line between the shoe liner 6 and the main body 4 is snugly positioned within the interior boundary of the main body 4, the shoe sole 1 becomes to have a good appearance. In addition, it is possible to prevent foreign substances from being introduced through the binding line, thereby resulting in the great enhancement of the durability of the shoe sole 1.

FIGS. 4 and 5 illustrate a shoe sole having a tunnel-type air chamber according to preferred second to fourth embodiments of the present invention.

At first, the shoe sole 1 according to the second embodiment of the present invention is constituted in the same manner as the shoe sole 1 according to the first embodiment of the present invention, except for a structure of the air chamber grooves. Accordingly, herein below the difference of the structure of the air chamber grooves in relation to the tunnel-type air chamber will be mainly described.

As will be best seen in FIGS. 4 and 5, in the shoe sole 1 according to the preferred second embodiment of the present invention, the shoe liner 6 has pluralities of air chamber grooves 6*a* which are formed at a bottom surface thereof. These air chamber grooves 6*a* are formed at a front portion of the bottom surface of the shoe liner 6. The air chamber grooves 6*a* of the shoe liner 6 correspond to the air chamber grooves 2*a* formed at the front portion of the main body 4. Likewise, the shoe liner 6 has pluralities of air chamber grooves 6*b* which are also formed at a bottom surface thereof. These air chamber grooves 6*b* are formed at a rear portion of the shoe liner 6. The air chamber grooves 6*b* correspond to the air chamber groove 2*b* formed at the front portion of the main body 4.

According to the preferred second embodiment of the present invention as described above, the shoe liner 6 is engaged with the main body 4 in a manner that the outer periphery of the lower surface of the shoe liner 6 is attached to the outer periphery of the upper surface of the main body 4 by using an adhesive agent and other portions of the shoe liner 6 are inserted into the recess 2 of the main body 4. Accordingly, the shoe liner 6 covers the open upper portions of the air chamber grooves 2*a*, 2*b*, thereby resulting in the creation of pluralities of oval tunnel-type air chambers 5*a*, 5*b* in the shoe sole 1. As a result, the shoe sole 1 according to the preferred second embodiment of the present invention becomes to have good elastic air cushioning and shock-absorbing effects. Consequently, the shoe sole 1 according to the preferred second embodiment of the present invention gets an advantage over the shoe sole 1 according to the preferred first embodiment of the present invention of which the bottom surface of the shoe liner 6 is flat.

In the meantime, as will be best seen in FIGS. 4 and 5, in the shoe sole 1 according to the preferred third embodiment of the present invention, the shoe liner 6 has pluralities of through holes 6*c* which are formed through thereof. These through holes 6*c* are formed at a front portion and a rear portion of the shoe liner 6. The through holes 6*c* formed at the front portion of the shoe liner 6 are fluid-communicated with the front air chamber grooves 6*a*. Likewise, the through holes 6*c* formed at the rear portion of the shoe liner 6 are fluid-communicated with the rear air chamber groove 6*b*.

According to the preferred third embodiment of the present invention as described above, a certain fluid such as air or water has free access to the shoe sole 1 via the through holes 6*c* and the tunnel-type air chambers 5*a*, 5*b*. Accordingly, it can give pleasant and refreshing feeling to a wearer during the entire walking gait cycle of the wearer at the summer season.

In the meantime, as will be best seen in FIGS. 4 and 5, in the shoe sole 1 according to the preferred fourth embodiment of the present invention, the shoe liner 6 has an arched supporting portion 7 which is formed at a center portion of an upper surface thereof. This arched supporting portion 7 bulges out at the upper surface of the shoe liner 6 and it corresponds to the shape of the sole of the foot.

According to the preferred fourth embodiment of the present invention as described above, the arched supporting portion 7 may uniformly support the sole of wearer's foot during the entire walking gait cycle of a wearer. Accordingly, some people with a low arch are able to walk in a more convenient and easier way. Furthermore, it is possible to obtain an acupressure effect at the arch portion of the sole of the foot so that the wearer can have a good circulation of blood. Consequently, this shoe sole enables a convenient stepping on walking to remarkably mitigate a fatigue with a massage effect produced from a proper stimulation of the flow of energy to prevent flat-foot walks and promote metabolism and blood circulation, and disperses the impact force caused by the weight to prevent diseases such as arthritis, back pain, muscle pain, or the like.

FIGS. 6 and 7 illustrate a shoe sole having a tunnel-type air chamber according to a preferred fifth embodiment of the present invention. As will be best seen in FIGS. 6 and 7, in the shoe sole 1 according to the preferred fifth embodiment of the present invention, the shoe liner 6 has an air chamber groove 8*a* for providing a center air chamber 8 in the shoe sole 1. This air chamber groove 8*a* is formed at a center portion of the lower surface of the shoe liner 6. A sealing protrusion 9 is formed at a circumferential outer periphery of the air chamber groove 8*a* and it protrudes downwards from the lower surface of the shoe liner 6. The main body 4 has an air chamber groove 8*b* for providing the center air chamber 8 in the shoe sole 1. This air chamber groove 8*b* is formed at a center portion of the upper surface of the main body 4 and it corresponds to the air chamber groove 8*a* of the shoe liner 6. An engaging groove 9*a* is formed at a circumferential outer periphery of the air chamber groove 8*b* and it corresponds to the sealing protrusion 9 of the shoe liner 6.

If the shoe liner 6 is engaged with main body 4, the sealing protrusion 9 formed at the center portion of the lower surface of the shoe liner 6 is fitted into the engaging groove 9*a* formed at the center portion of the upper surface of the main body 4. As a result, the center air chamber 8 may be created due to the integration of the air chamber grooves 8*a*, 8*b*. The air contained in the center air chamber 8 may not be leaked due to the airtight engagement between the sealing protrusion 9 and the engaging groove 9*a*. Although a wearer uses the shoe sole 1 according to the present invention for a long time, the air contained in the center air chamber 8 may not be leaked, thereby resulting in the prevention of poor shock damping effect.

According to the preferred fifth embodiment of the present invention as described above, the impact force caused by the weight of the wearer during walking or running of the wearer on the uneven road can be absorbed due to operation of the center air chamber 8, thereby resulting in the great enhancement of feelings to wear.

FIG. 8 is a side sectional view of the shoe sole having a tunnel-type air chamber according to a preferred sixth embodiment of the present invention. Referring to FIG. 8, in the shoe sole 1 according to the preferred sixth embodiment of the present invention, a recess 2 is only formed at the rear portion of the upper surface of the main body 4. An air chamber groove 2*b* is formed in the recess 2. The shoe liner 6 has an air chamber groove 6*b* for providing the tunnel-type air chamber 5*b* in the shoe sole 1 at the lower surface of the shoe liner 6. The air chamber groove 6*b* corresponds to the air chamber groove 2*b* of the main body 4. If the shoe liner 6 is engaged with the main body 4, an outer periphery of the lower surface of the shoe liner 6 may be attached to an outer periphery of the upper surface of the main body 4, and other portions of the shoe liner 6 are inserted into the recess 2 of the main body 4. Accordingly, the shoe liner 6 covers the open upper portion of the air chamber groove 2*b*, thereby resulting in the formation of the tunnel-type air chamber 5*b* only at the heel portion of the shoe sole 1 in which a great foot pressure may be applied thereto during the entire walking gait cycle of a wearer.

As described above, in the shoe sole having the tunnel-type air chambers according to the present invention, the recess for receiving a part of the shoe liner is formed in the upper surface of the main body and the non-slip cushion sheet is attached to the bottom surface of the main body. Pluralities of air chamber grooves are formed in the recess at the front portion of the main body. Also, one air chamber groove is formed in the recess at the rear portion of the main body. All of air chamber grooves horizontally extend through both side walls of the main body. The outer periphery of the shoe liner may be attached to an outer periphery of the upper surface of the main body, and other portions of the shoe liner are inserted into the recess of the main body. Accordingly, the shoe liner covers the open upper portion of the air chamber groove, thereby resulting in the formation of the tunnel-type air within the shoe sole. Due to this structure, since the binding line between the shoe liner and the main body is snugly positioned within the interior boundary of the main body, the shoe sole becomes to have a good appearance. Further, it is possible to prevent foreign substances from being introduced through the binding line, and thereby resulting in great enhancement of the durability of the shoe sole.

Furthermore, in the shoe sole having the tunnel-type air chambers according to the present invention, pluralities of through holes are formed through the shoe liner. These through holes are fluid-communicated with the tunnel-type air chambers of the main body. Furthermore, the arched supporting portion is formed at the center portion of the upper surface of the shoe liner and it bulges out at the upper surface of the shoe liner. In addition, the center air chamber is provided between the center portion of the lower surface of the shoe liner and the center portion of the upper surface of the main body. Due to this structure, it can give pleasant and refreshing feeling to a wearer during the entire walking gait cycle of the wearer at the summer season. Further, the arched supporting portion may uniformly support the sole of wearer's foot during the entire walking gait cycle of a wearer. Consequently, it is possible to enhance the functionality and the feelings to wear.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A shoe sole comprising:

a main body including a recess formed at an upper surface thereof and a non-slip cushion sheet attached to a bottom surface thereof, in which pluralities of air chamber grooves are formed in the recess at a front portion of the main body and an air chamber groove is formed in the recess at a rear portion of the main body, and the air chamber grooves horizontally extend through both side walls of the main body;

a shoe liner for covering open upper portions of the air chamber grooves so as to provide pluralities of tunnel-shaped air chambers, in which an outer periphery of the shoe liner is attached to an outer periphery of the upper surface of the main body, and other portions of the shoe liner are inserted into the recess;

pluralities of air chamber grooves being arranged on a front portion of the lower surface of the shoe liner and an air chamber groove is arranged on a rear portion of the lower surface of the shoe liner, in which the air chamber grooves correspond to the air chamber grooves of the main body, respectively; and an air chamber groove for providing a center air chamber in the shoe sole is formed at a center portion of the lower surface of the shoe liner, wherein a sealing protrusion is formed at a circumferential outer periphery of the air chamber groove and protrudes downwards from the lower surface of the shoe liner, wherein an air chamber groove for providing the center air chamber in the shoe sole is formed at a center portion of the upper surface of the main body and corresponds to the air chamber groove of the shoe liner, and wherein an engaging groove is formed at a circumferential outer periphery of the air chamber groove and corresponds to the sealing protrusion of the shoe liner.

2. A shoe sole comprising:

a main body including a recess formed at an upper surface thereof and a non-slip cushion sheet attached to a bottom surface thereof, in which pluralities of air chamber grooves are formed in the recess at a front portion of the main body and an air chamber groove is formed in the recess at a rear portion of the main body, and the air chamber grooves horizontally extend through both side walls of the main body;

a shoe liner for covering open upper portions of the air chamber grooves so as to provide pluralities of tunnel-shaped air chambers, in which an outer periphery of the shoe liner is attached to an outer periphery of the upper surface of the main body, and other portions of the shoe liner are inserted into the recess;

pluralities of air chamber grooves being arranged on a front portion of the lower surface of the shoe liner and an air chamber groove is arranged on a rear portion of the lower surface of the shoe liner, in which the air chamber grooves correspond to the air chamber grooves of the main body, respectively;

pluralities of through holes being formed through the shoe liner, the through holes being formed at the front portion and the rear portion of the shoe liner, and the through holes being fluid-communicated with pluralities of air chamber grooves; and an air chamber groove for providing a center air chamber in the shoe sole is formed at a center portion of the lower surface of the shoe liner, wherein a sealing protrusion is formed at a circumferential outer periphery of the air chamber groove and protrudes downwards from the lower surface of the shoe liner, wherein an air chamber groove for providing the center air chamber in the shoe sole is formed at a center portion of the upper surface of the main body and corresponds to the air chamber groove of the shoe liner, and wherein an engaging groove is formed at a circumferential outer periphery of the air chamber groove and corresponds to the sealing protrusion of the shoe liner.

3. A shoe sole comprising:

a main body including a recess formed at an upper surface thereof and a non-slip cushion sheet attached to a bottom surface thereof, in which pluralities of air chamber grooves are formed in the recess at a front portion of the main body and an air chamber groove is formed in the recess at a rear portion of the main body, and the air chamber grooves horizontally extend through both side walls of the main body;

a shoe liner for covering open upper portions of the air chamber grooves so as to provide pluralities of tunnel-shaped air chambers, in which an outer periphery of the shoe liner is attached to an outer periphery of the upper surface of the main body, and other portions of the shoe liner are inserted into the recess;

pluralities of air chamber grooves being arranged on a front portion of the lower surface of the shoe liner and an air chamber groove is arranged on a rear portion of the lower surface of the shoe liner, in which the air chamber grooves correspond to the air chamber grooves of the main body, respectively;

an arched supporting portion being formed at a center portion of the upper surface of the shoe liner, the arched supporting portion bulging out at the upper surface of the shoe liner and corresponding to the shape of the sole of the foot; and an air chamber groove for providing a center air chamber in the shoe sole is formed at a center portion of the lower surface of the shoe liner, wherein a sealing protrusion is formed at a circumferential outer periphery of the air chamber groove and protrudes downwards from the lower surface of the shoe liner, wherein an air chamber groove for providing the center air chamber in the shoe sole is formed at a center portion of the upper surface of the main body and corresponds to the air chamber groove of the shoe liner, and wherein an engaging groove is formed at a circumferential outer periphery of the air chamber groove and corresponds to the sealing protrusion of the shoe liner.

* * * * *